US009962024B2

(12) United States Patent
Weislogel et al.

(10) Patent No.: US 9,962,024 B2
(45) Date of Patent: May 8, 2018

(54) CAPILLARY BEVERAGE CUP

(71) Applicant: IRPI LLC, Wilsonville, OR (US)

(72) Inventors: Mark M. Weislogel, Tigard, OR (US); Donald R. Pettit, Houston, TX (US); Andrew P. Wollman, Portland, OR (US); Ryan M. Jenson, Portland, OR (US)

(73) Assignee: IRPI LLC, Wilsonville, OR (US)

( * ) Notice: Subject to any disclaimer, the term of this patent is extended or adjusted under 35 U.S.C. 154(b) by 0 days. days.

(21) Appl. No.: 14/534,041

(22) Filed: Nov. 5, 2014

(65) Prior Publication Data

US 2016/0088959 A1 Mar. 31, 2016

Related U.S. Application Data

(60) Provisional application No. 62/057,161, filed on Sep. 29, 2014.

(51) Int. Cl.
*A47G 19/22* (2006.01)
*B65D 25/14* (2006.01)

(52) U.S. Cl.
CPC ..... *A47G 19/2266* (2013.01); *B65D 25/14* (2013.01); *A47G 2400/10* (2013.01)

(58) Field of Classification Search
USPC ..... 220/703, 719, 717, 716, 657; 222/566, 222/475.1
See application file for complete search history.

(56) References Cited

U.S. PATENT DOCUMENTS 4,146,157 A * 3/1979 Dixon, Sr. ..... A47G 19/2272 220/703
4,235,348 A * 11/1980 Watson ..... A47G 19/2266 206/427
7,503,461 B1 * 3/2009 Hoffman ..... A61J 9/04 215/11.5
8,074,827 B2 12/2011 Pettit et al.
2002/0070225 A1 * 6/2002 Bergeron ..... A47G 19/2266 220/710.5

(Continued)

OTHER PUBLICATIONS

Pettit, D., "Astronaut Demos Drinking Coffee in Space," YouTube Video Uploaded Nov. 2008, https://www.youtube.com/watch?v=pk7LcugO3zg, 4 pages.

(Continued)

*Primary Examiner* — James N Smalley
*Assistant Examiner* — Madison L Poos
(74) *Attorney, Agent, or Firm* — McCoy Russell LLP

(57) ABSTRACT

A capillary beverage cup comprises a continuous interior corner extending from a lip interface into an inner cavity of the capillary beverage cup, the continuous interior corner comprising an acute included angle which tapers continuously as the interior corner approaches the lip interface. The capillary beverage cup provides a continuous capillary force on the liquid contained by the cup, allowing for complete withdrawal of fluid from the cup in low or near zero gravity environments, while enabling the cup to have an open top, allowing for aromatics to be experienced by a user while drinking with reduced concerns of spilling or release free-floating spheres of liquid in the low-gravity environment.

15 Claims, 11 Drawing Sheets

(56) References Cited

U.S. PATENT DOCUMENTS

2006/0131349 A1* 6/2006 Kaas ..... A47J 43/288
222/566

OTHER PUBLICATIONS

Baldwin, T., "On-Orbit Coffee Cup Design to Use in Spacecraft," Tuvie.com—Design of the Future Website, https://web.archive.org/web/20101204205556/http://www.tuvie.com/on-orbit-coffee-cup-design-to-use-in-spacecraft/, Available as Early as Dec. 2010, 10 pages.

Weislogel, M. et al., "Quasi-Steady Capillarity-Driven Flows in Slender Containers with Interior Edges," J. Fluid Mech., vol. 685, Oct. 2011, 35 pages.

Weislogel, Mark M. et al., "In-Line Passive Fluid Phase Separator," U.S. Appl. No. 61/845,263, filed Jul. 11, 2013, 20 pages.

"Drinking Martini in Space with 3D-Printed Cocktail Glasses for Zero Gravity," 3ders.org—3D printer and 3D printing news, http://www.3ders.org/articles/20140612-drinking-martini-in-space-with-3d-printed-cocktail-glass-for-zero-gravity.html, Jun. 12, 2014, 12 pages.

Newman, L., "What Do You Call Italian Coffee for the International Space Station? ISSpresso!," Slate Magazine Online Edition—Future Tense—The Citizen's Guide to the Future, http://www.slate.com/blogs/future_tense/2014/06/16/isspresso_coffee_for_space_from_lavazza_argotec_and_the_italian_space_agency.html, Jun. 16, 2014, 2 pages.

"Cosmic Lifestyle Corporation Homepage," https://web.archive.org/web/20140806201211/http://www.cosmiclifestyle.com/, Available as Early as Aug. 2014, 2 pages.

* cited by examiner

CAPILLARY BEVERAGE CUP

CROSS REFERENCE TO RELATED APPLICATION

This application claims priority to U.S. provisional patent application, Ser. No. 62/057,161, entitled "CAPILLARY BEVERAGE CUP," and filed on Sep. 29, 2014, the entire contents of which are hereby incorporated by reference for all purposes.

BACKGROUND AND SUMMARY

Typical beverage cups with an open top and open rim designed for standard gravity applications lose their functionality when employed in zero gravity or microgravity environments such as those found on spacecraft and space stations. A beverage placed inside such a cup will adhere to the base of the cup interior due to capillary forces. The adherence is maintained regardless of the orientation of the cup, making it impossible for a user to tilt the beverage towards the rim, and thus preventing the user from imbibing in the typical fashion. Further, any inertial forces applied to the cup that are greater than the capillary forces will cause the beverage to dissociate from the cup.

The current, widely accepted method for imbibing liquids in space utilizes completely sealed vesicles, such as a bag. Liquids may be withdrawn from the bag via a user sucking through a straw, or by squeezing the bag by hand, forcing liquid out of the bag and into the mouth of a user. By completely containing the liquids in a sealed vesicle, clean delivery is ensured. However, flavor is reduced, as aromatics are nearly completely eliminated. Further, the experience of sipping or drinking a beverage is lost, and the user may feel unsophisticated by being limited to sucking liquids from a bag. Especially for individuals who spend extended periods of time at a space station, even modest comforts of home may improve their mental health and well-being. For extended missions, it may also prove effective to rely on reusable cups rather than disposable bags.

U.S. Pat. No. 8,074,827 describes one approach for providing an open-topped beverage cup for use in low gravity environments. The beverage cup described therein uses a corner channel to exploit capillary forces and allow a beverage contained therein to be directed to the rim of the cup. However, the design has limitations, as recognized by the inventors herein. For example, the capillary pressure gradient dissipates as the liquid level decreases, thereby making it difficult to completely drain a beverage from the cup in a reasonable amount of time. This problem is aggravated by the fact that no capillary gradient is established along the interior corner to promote a more conducive drinking rate. As another example, the corner channel extends to the rim of the cup, forcing the user to drink from a tapered point, making the experience less like drinking at standard gravity. Further, the stability of the beverage within the cup is limited, reducing the amount of liquid that may be held therein while maintain capillary forces in excess of potential inertial forces.

A capillary beverage cup may be used to provide a liquid for drinking in a low-gravity environment. The capillary beverage cup may comprise an open top, allowing for aromatics to be experienced by a user while drinking. The capillary beverage cup may provide a continuous capillary force on the liquid contained by the cup, utilizing a continuous interior corner extending from a lip interface into an inner cavity of the capillary beverage cup that is activated as fluid is removed from the lip interface. The continuous interior corner may comprise an acute included angle which tapers continuously as the interior corner approaches the lip interface, allowing the cup to provide continuous increased capillary under-pressure (e.g. suction) on liquids with a contact angle less than 70°. The lip interface may comprise a cusp-shaped channel that is continuous with the continuous interior corner and extends to an edge of the lip interface. In this way, a rivulet of liquid may be presented at the lip interface for imbibing, the upper lip providing a capillary connection with the liquid in the cusp and thus the entire liquid contents within the cup. A user may withdraw the liquid by applying a sucking force, or with small quantities of liquid wicked into the mouth without applying a sucking force, but by merely coupling the user's lip to the lip interface of the cup. The capillary beverage cup may include a rounded, low-curvature region assuring that the vessel is completely drained by the continuous interior corner, though the interior corner may not extend into the rounded, low curvature region.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTIONS OF THE DRAWINGS

DETAILED DESCRIPTION

This detailed description relates to cups for drinking beverages in low-gravity environments, for example lower than standard gravity on earth. In one example, this description relates to cups that leverage capillary action to passively pump fluid from the interior of the cup to a lip interface, where the beverage may be imbibed by a user. Such cups may be expected to function effectively provided the impacts of surface tension and cup geometry are significantly greater than the impact of gravity, allowing for use in standard gravity (e.g. on Earth), sub-standard gravity (e.g. on the Moon, on Mars, on asteroids and/or other fractional bodies), or low to near zero gravity (e.g. free flying in outer space).

Figure 1B:
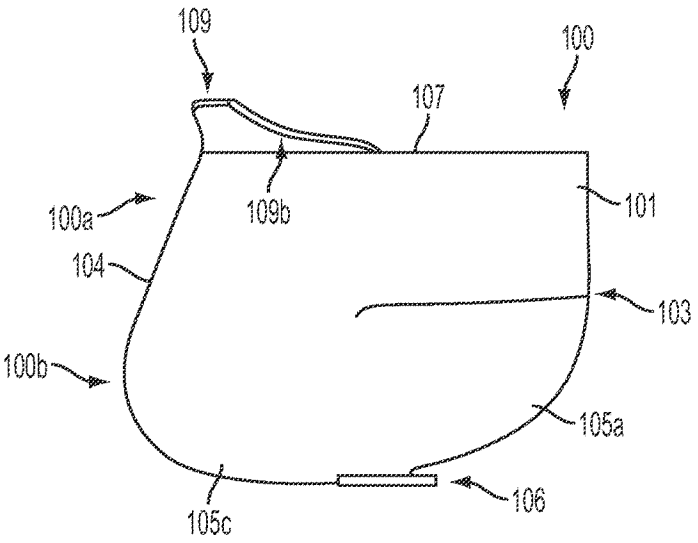
FIGS. 1A-1G show perspective views of an example capillary beverage cup.
Figure 1C:
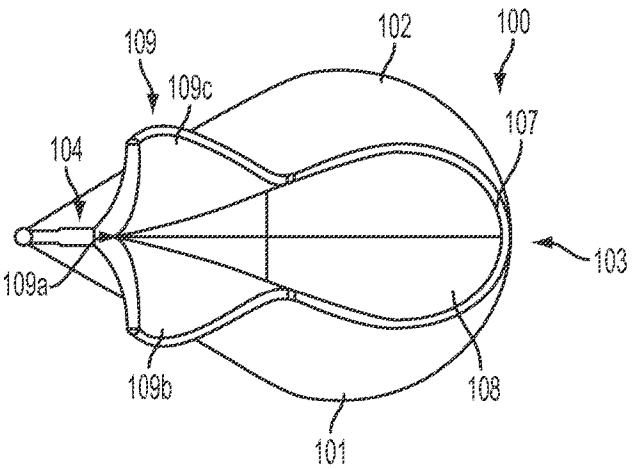
Figure 1A:
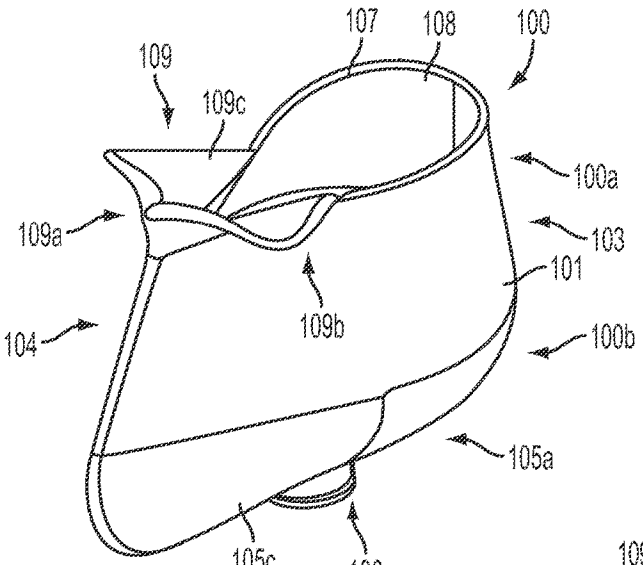
Figure 1E:
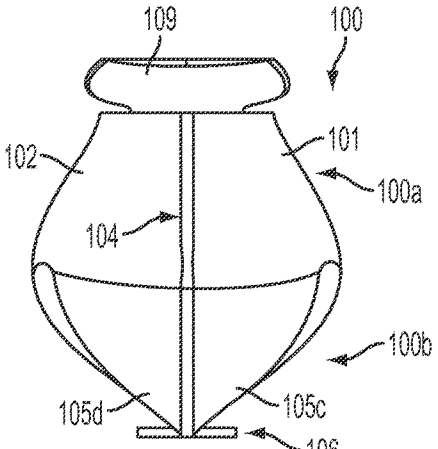
Figure 1G:
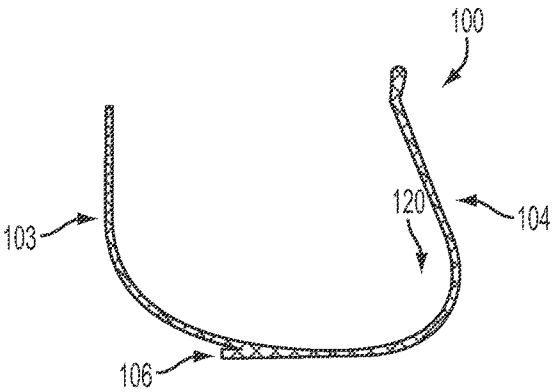
Figure 1D:
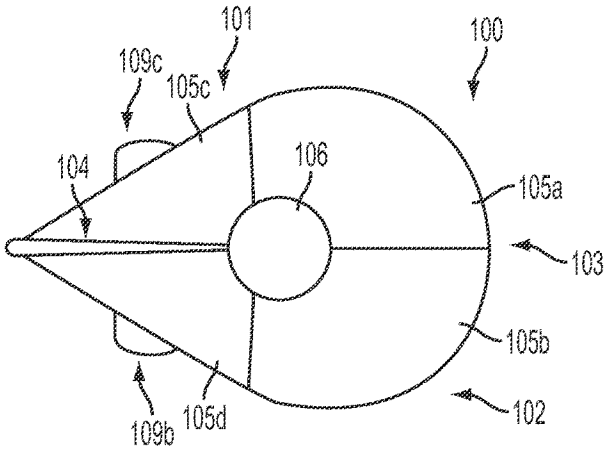
Figure 1F:
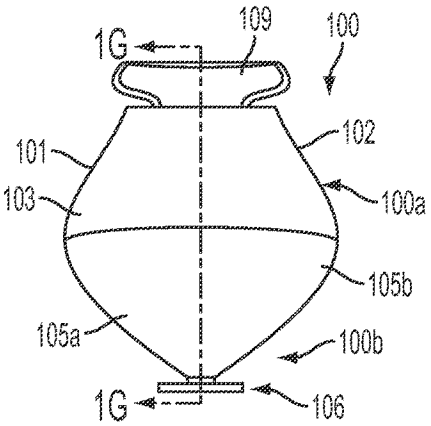

FIGS. 1A-1G show perspective views of an example capillary beverage cup 100. FIG. 1A shows a view of capillary beverage cup 100 from angled perspective. FIG. 1B depicts capillary beverage cup 100 as viewed in profile from the right side. FIG. 1C depicts capillary beverage cup 100 as viewed from the top-down. FIG. 1D depicts capillary beverage cup 100 as viewed from the bottom-up. FIG. 1E depicts capillary beverage cup 100 as viewed from the front. FIG. 1F depicts capillary beverage cup 100 as viewed from the rear. FIG. 1G shows a cross-section of capillary beverage cup 100 taken along axis A-A, as shown in FIG. 1F.

Capillary beverage cup 100 may be constructed from any suitable material provided the material establishes the necessary wetting characteristics between the liquid and the cup. For example, capillary beverage cup 100 may be constructed from rigid and/or flexible materials, such as metal, etc. Capillary beverage cup 100 may comprise a single, molded piece of material, or may comprise a plurality of pieces of material connected into a single structure. In the description herein, reference will be made to numerous faces and portions of the cup. It should be understood that a single piece of material may form two or more faces or portions, and/or that adjacent faces or portions may be seamlessly connected. As described herein, capillary beverage cup 100 may be constructed out of relatively thin material, allowing for the outer geometry of the cup to have similar shapes, curves, and angles as the inner geometry. However, the described inner geometries may be placed within any suitable outer casing that gives the cup improved aesthetics or ergonomics without compromising the liquid holding properties of the cup interior. For capillary beverage cup 100, the advancing contact angle for the interior corner(s) must be less than the critical geometric wetting angle (i.e., Concus-Finn angle). Such a favorable wetting condition may be achieved by selection of material, material surface finish, cup fill method, or by applying a hydrophilic coating to at least the interior surfaces of the cup.

Capillary beverage cup 100 comprises an upper right face 101 and an upper left face 102. Upper right face 101 and upper left face 102 are convex surfaces, intersecting at both the front and rear of the cup. At the rear of the cup, the upper left and right faces form an upper portion of rear face 103. Upper right face 101 and upper left face 102 intersect at the front of the cup at tapered front face 104. An upper portion 100*a* of capillary beverage cup 100 is formed by faces 101, 102, 103, and an upper portion of tapered front face 104. As shown in FIG. 1C, the faces 101, 102, and 103 join to form a circular profile at the rear of the cup, though the profile may be more ellipsoid in some embodiments. From the midpoint of cup 100, faces 101 and 102 taper somewhat linearly toward tapered front face 104. Thus, as viewed from the top (FIG. 1C) or bottom (FIG. 1D), cup 100 has a teardrop profile. As viewed from the front (FIG. 1E) or rear (FIG. 1F), upper portion 100*a* tapers from the widest section of the cup towards rim 107. The general teardrop shape may be maintained in cross-sections of upper portion 100*a*, though the profile decreases in size as upper portion 100*a* approaches rim 107. In this example, upper right face 101 and upper left face 102 demonstrate a sigmoidal profile when viewed from the front or rear, tapering towards rim 107 first as a concave-down curve, gradually transitioning to a concave-up curve. However, other more linear tapering profiles may be used, such as those shown in the example capillary beverage cup depicted in FIGS. 3A-3I. Rim 107 defines the boundaries of open top 108. By maintaining an open top, capillary beverage cup 100 allows aromatics to escape from open top 108. In this way, a user may smell the beverage contained therein, allowing for increased flavor sensation and a more pleasing drinking experience. However, leaving an open top demands that cup 100 maintains beverages stably within, so that inertial forces will not cause liquid to spill or release free-floating spheres in the low-gravity environment. The open top may comprise a smaller characteristic dimension (i.e., radius of curvature) than the body of the cup to enhance dynamic capillary stability and resist spillage.

A lower portion 100*b* of capillary beverage cup 100 comprises rear bottom faces 105*a* and 105*b* as well as front bottom faces 105*c* and 105*d*. Rear bottom faces 105*a* and 105*b* form a rounded, low-curvature region comprising generally spherical geometry, intersecting at a lower portion of rear face 103, as well as at the underside of cup 100, as shown in FIG. 1D. As shown in FIG. 1F, rear bottom faces 105*a* and 105*b* taper as they approach base 106. In this example, rear bottom faces 105*a* and 105*b* taper symmetrically, forming two sides of a semicubical parabola. However, in other embodiments, the rear bottom faces may form a structure that more closely approximates a sphere. In yet other embodiments, such as the examples shown in FIGS. 3A-3I, and 4A-4F, the rear bottom faces may intersect only at rear face 103, and not at the bottom of the cup. Rather, a flat or convex curved surface may form the base of the cup. The generally spherical geometry of the lower portion 100*b* enhances the stability of the contained liquid per unit volume by presenting a liquid volume which is characterized by the cube of the radius of the (spherical) lower portion 100*b*, whereas the dynamic stability of the free surface is characterized by the square of the radius of the (teardrop-shaped) lip interface 107.

Tapered front face 104 extends from base 106, connecting front bottom faces 105*c* and 105*d* as well as upper right face 101 and upper left face 102. As will be described further herein and with regards to FIGS. 2A-2H, the tapered front face allows for the interior of cup 100 to form an interior corner extending from the base to lip interface 109. The interior corner comprises a tapering channel profile, enabling a continuous capillary gradient that draws liquid towards lip interface 109 where it may be sipped and/or drank by a user. The continuous capillary gradient further allows for capillary action forces to be applied to liquid within cup 100 regardless of liquid level. Tapered front face 104 forms an acute angle at the intersection between upper right face 101 and upper left face 102 that decreases in angle as upper right face 101 and upper left face 102 taper towards lip interface 109. Similarly, tapered front face 104 forms an acute angle at the intersection between front bottom faces 105*c* and 105*d* that decreases in angle as front bottom faces 105*c* and 105*d* taper from base 106 towards the upper portion 100*a*.

The upper portion of interior corner 120 formed by upper right face 101, upper left face 102, and tapered front face 104 directs liquid to lip interface 109. Interior corner 120 extends into an inner cavity of cup 100. Lip interface 109 forms a cusp-shaped channel 109*a* (referred to herein as cusp 109*a* for simplicity) that is continuous with interior corner 120. Liquid flow will stop at cusp 109*a* when the liquid meets a free surface that defines a capillary force equilibrium. Cusp 109*a* thus allows for liquid to be delivered from cup 100 to the lips of a user by providing a natural capillary connection between the cup and the user's lips during drinking. By gently applying a light sucking pressure, the user may withdraw liquid from the cup into the user's mouth. The measure of fluid at cusp 109*a* creates a capillary pressure gradient that acts throughout the cup to passively pump all of the remaining liquid in the cup to the mouth. In this example, lip interface 109 comprises right lip interface 109*b* and left lip interface 109*c*. Right lip interface 109*b* and left lip interface 109*c* form an ergonomic interface for a user's lips. Right lip interface 109*b* and left lip interface 109*c* each have a rounded, concave shape, roughly coinciding to the profile of the top lip of a prospective user. In this way, lip interface 109 naturally positions the user's upper lip above cusp 109*a*, allowing for any sucking pressure to be directed directly to cusp 109*a* and thus directly applied to liquid located at the cusp. However, right lip interface 109*b* and left lip interface 109*c* are not required for the function of cup 100. Other lip interface designs may be used, such as those shown in FIG. 3A or FIG. 4E.

In this example, base 106 has a circular shape with a flat surface that has a significantly smaller area than does the lower portion 100*b*, though other dimensions and shapes may be used. Base 106 may be configured to tether capillary beverage cup 100 to a surface in low gravity. For example, base 106 may be formed of a magnetic material or VELCRO® material that would allow capillary beverage cup 100 to be affixed to a surface. In some examples, base 106 may comprise a male part of a male-female docking station.

Although not shown, capillary beverage cup 100 may include a fill port or other interface to allow liquid to be delivered to the interior of the cup without undue spillage. For example, a duck-bill valve may be used as a fill port. A fill port may be located within base 106 or elsewhere tangential to the outer surface of cup 100, provided the fill port does not disrupt the interior walls that form interior corner 120. Further, the fill port must be configured to deliver liquid to interior corner 120, in order to establish the capillary gradient. Any suitable device may be used to deliver liquid to cup 100, either through a dedicated fill port, or through open top 108, provided the liquid is provided to interior corner 120. The corner wetting phenomena provides a passive means of fluid pumping, effectively trading the forces of surface tensions with those of gravity in the drinking process. Once liquid is delivered into the cup, fluid preferentially distributes within the interior of the cup based on the interior dimensions. In a scenario where the fluid is not delivered in a manner that engages the primary interior corner, the cup may be lightly sloshed by hand as a means of connecting the bulk fluid with interior corner 120.

Additional perspective views of the example capillary beverage cup depicted in FIGS. 1A-1G may be found in FIGS. 5A-5D.

Figure 2A:
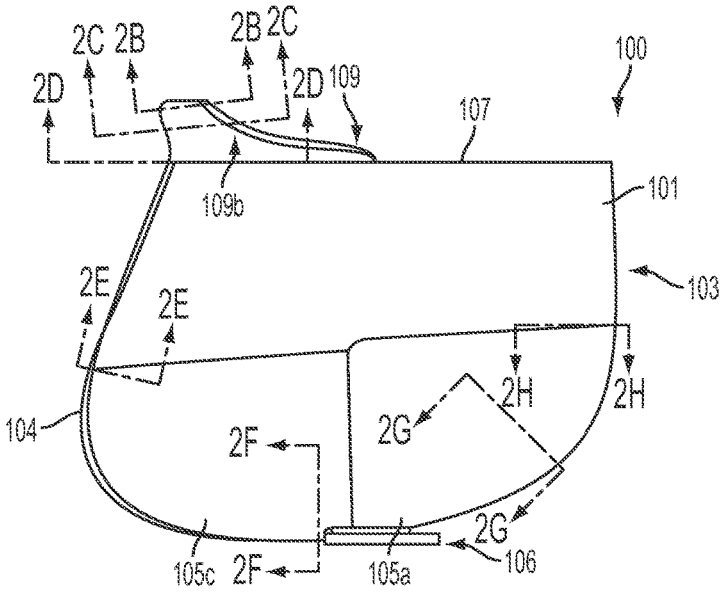
FIGS. 2A-2H show cross-sectional views of portions of the example capillary beverage cup depicted in FIGS. 1A-1G.
Figure 2B:
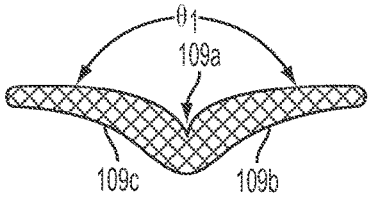
Figure 2C:
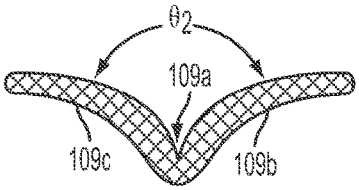
Figure 2D:
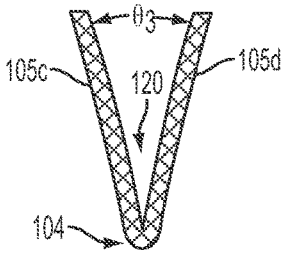
Figure 2E:
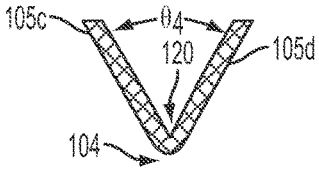
Figure 2F:
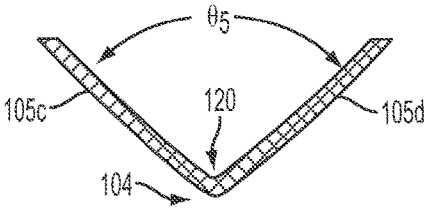
Figure 2G:
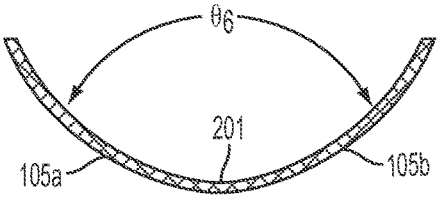
Figure 2H:
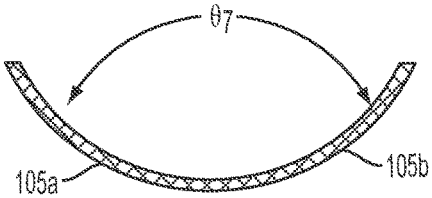

FIG. 2A shows capillary beverage cup 100 as viewed in profile from the right side. FIGS. 2B-2H show cross-sectional views of cup 100 taken along axes B-B through H-H, respectively. FIGS. 2B-2C show cross-sectional views of lip interface 109. FIGS. 2D-2E show cross-sectional views of tapered front face 104 intersecting with upper right face 101 and upper left face 102. FIG. 2F shows a cross-sectional view of tapered front face 104 intersecting with front bottom faces 105*c* and 105*d*. FIG. 2G shows a cross-sectional view of the intersection of rear bottom faces 105*a* and 105*b*. FIG. 2H shows a cross-sectional view of rear face 103 at the intersection of upper right face 101 and upper left face 102 with rear bottom faces 105*a* and 105*b*.

Section H-H, as shown in FIG. 2H has a circular profile with an included angle characterized by $\theta_7$ between rear bottom faces 105*a* and 105*b*. At section H-H, rear bottom faces 105*a* and 105*b* intersect seamlessly, forming the circular cross-section. The circular profile is maintained from axis H-H through rim 107, although the radius of subsequent cross-sections may decrease while approaching the rim. Section G-G, as shown in FIG. 2G has a relatively circular profile, however the included angle characterized by $\theta_6$ is slightly smaller than included angle $\theta_7$, as rear bottom faces 105*a* and 105*b* intersect at vertex point 201.

Section F-F, as shown in FIG. 2F has a V-shaped profile with an included angle of $\theta_5$ between rear and front faces 105*c* and 105*d*. In this example, interior corner 120 acts as the vertex between the two faces. As the interior corner progresses from section F-F through lip interface 109, the V-shaped profile is maintained, but the included angle between the adjacent faces decreases. For example, section E-E, as shown in FIG. 2E is a cross-section at the interface between rear front faces 105*c* and 105*d* and upper right and left faces 101 and 102. Section E-E has an included angle of $\theta_4$, while $\theta_4$ is less than $\theta_5$. Progressing further along interior corner 120, section DD, as shown in FIG. 2D is a cross-section at the interface between upper right and left faces 101 and 102 and right and left lip interfaces 109*b* and 109*c*. Section D-D has an included angle of $\theta_3$, while $\theta_3$ is less than $\theta_4$. Cross-sections located between section F-F and section E-E have included angles less than $\theta_5$ but greater than $\theta_4$. Similarly, cross-sections located between section E-E and section D-D have included angles less than $\theta_4$ but greater than $\theta_3$. Thus, interior corner 120 tapers continuously from base 106 to lip interface 109. In this way, liquid within cup 100 always has a capillary force drawing the liquid towards lip interface 109 when liquid is removed from cup 100. During conditions where liquid is not being drawn from the cup, the capillary gradient established by the tapering interior corner of the cup shifts the bulk fluid towards the lip interface, thus shortening the distance required to withdraw fluid, increasing the rate of fluid withdrawal as the total fluid remaining within the cup decreases, and assuring nearly complete draining of the cup while maintain a natural drinking process. The constant capillary force allows for capillary action to be applied to liquid within the cup regardless of the liquid level. As the low curvature region has relatively low capillary forces acting on liquid therein, this allows for complete drainage of the liquid contents.

For a time-efficient uptake of liquid, the wetting conditions of the liquid and solid interior surface should satisfy the practical geometric interior corner wetting condition, where $\theta_{adv}<(\pi/2-\alpha)$; a modification of the Concus-Finn condition [1969] $\theta_{eq}<(\pi/2-\alpha)$, where $\theta_{adv}$ and $\theta_{eq}$ are the respective advancing and equilibrium contact angles and a is the half-angle of the interior corner with all angles measure in radians. The vessel will function if $\theta_{eq}$ replaces $\theta_{adv}$, but the time required for such function is so large as to be impractical. For relatively rapid capillary delivery of liquid, it is desirable to establish $\theta_{adv}$ that is sufficiently smaller than $\lambda/2-\alpha$. For a fixed $\theta_{adv}$, this is accomplished in capillary beverage cup 100 by methodically decreasing a towards the lip, eventually forming a cusp where satisfaction of $\theta_{adv}<\pi/2-\alpha$ is certain for most aqueous liquids.

The tapering interior corner also narrows the open portion of cup 100. This enhances the stability of liquid within cup 100 per unit volume, allowing for greater volumes to be stored within the cup, allowing for larger lateral and upward disturbances to the cup with a reduced concern of spilling. The stability is further promoted by the spherical geometry of the lower, rear portion of the cup. In this example, the ratio of the height of the lower, spherical portion of the cup 100*b* to the upper, tapered portion of the cup 100*a* is approximately 1:1. This ratio provides stability to liquid stored in the cup despite small inertial perturbations, while allowing the capillary action of the interior corner to drain all or nearly all of the contents to the lip interface. As liquid is drained, the tapered interior shape shifts the bulk liquid ever forward towards the lip interface, eventually draining the contents of the cup.

As shown in FIGS. 1 and 2, the angles and angle gradients of interior corner 120 are designed for fluids with advancing contact angles less than 70°, although other, similar configurations may be used for fluids with advancing contact angles up to 80°. As such, capillary beverage cup 100 may be used for a wide array of liquid beverages in low-gravity conditions, such as milk, juice, beer, wine, coffee, tea, cocoa, etc. For liquids such as clean water or other poorly wetting liquids, additional design constraints may be necessary to reduce the wetting angle between the liquid and the interior surface. For example, the interior surface may be coated with a hydrophilic surface. In another example, the inner cavity of the capillary beverage cup may comprise a textured and/or hemi-porous surface to enhance wettability. In this way, the adherence of the liquid to the interior surface may be reduced, thereby reducing the advancing contact angle $\theta_{adv}$. Thus, the capillary forces of the interior corner may be sufficient to draw liquid from the lower portion of the cup towards the lip.

Section C-C, as shown in FIG. 2C has a semicubical parabola-shaped profile with an included angle of $\theta_2$ between right lip interface 109*b* and 109*c*. Interior corner 120 seamlessly transitions into cusp 109*a*. This ensures that whenever there is liquid in the cup, a rivulet of liquid is always present at cusp 109*a*. Section B-B, as shown in FIG. 2B, depicts the edge of the lip interface. Section B-B also has a semicubical parabola-shaped profile. Section B-B comprises an included angle of $\theta_1$ between right lip interface 109*b* and 109*c* where $\theta_1$ is greater than $\theta_2$. Cusp 109*a* will allow for liquid to reach the edge of the lip interface, but the broader included angle at the edge of the lip interface allows for ergonomic interaction between the user's lip and the lip interface, focusing the direction of sucking forces applied by the user. As interior corner 120 transitions into cusp 109*a*, the constant capillary gradient is maintained, and stability of liquid at the lip interface is increased. In this way, the capillary beverage cup presents a continually decreasing interior corner half-angle $\alpha$ toward the lip interface that provides the desirable increasing corner wetting, and thus the wicking characteristics of the cup.

Although capillary beverage cup 100 may be used in low-gravity environments, the beverage cup may also be used in standard-gravity environments. Base 106 may be used to balance cup 100 on a level surface on Earth, an artificial gravity environment, or reduced gravity environments (e.g. Lunar, Martian, asteroid, etc.) without the use of additional adherents. Further, liquid may be poured or imbibed from either the lip interface 109 or the rear portion of rim 107 in scenarios where the force of gravity is greater than the capillary force applied by interior corner 120.

Figure 3A:
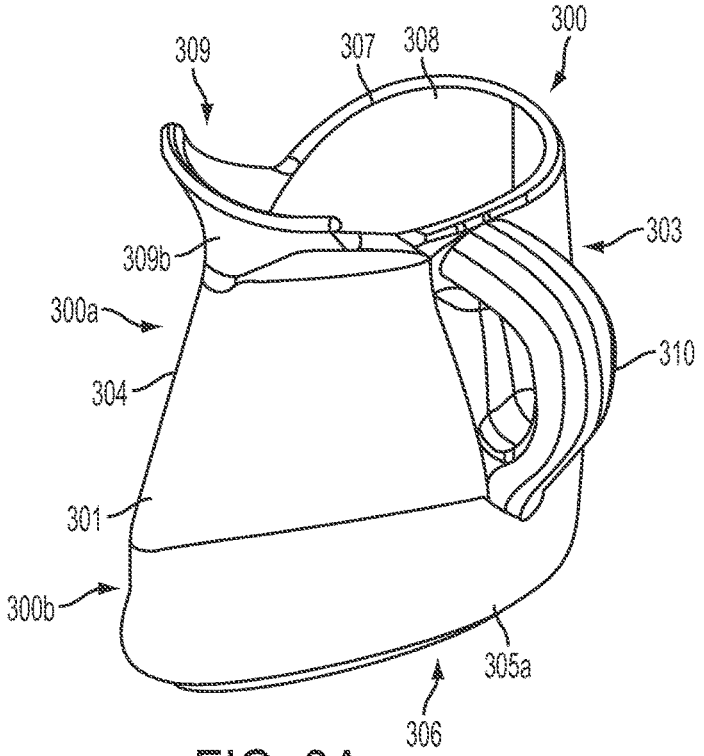
FIGS. 3A-3I show perspective and cross-sectional views of an example capillary beverage cup.
Figure 3B:
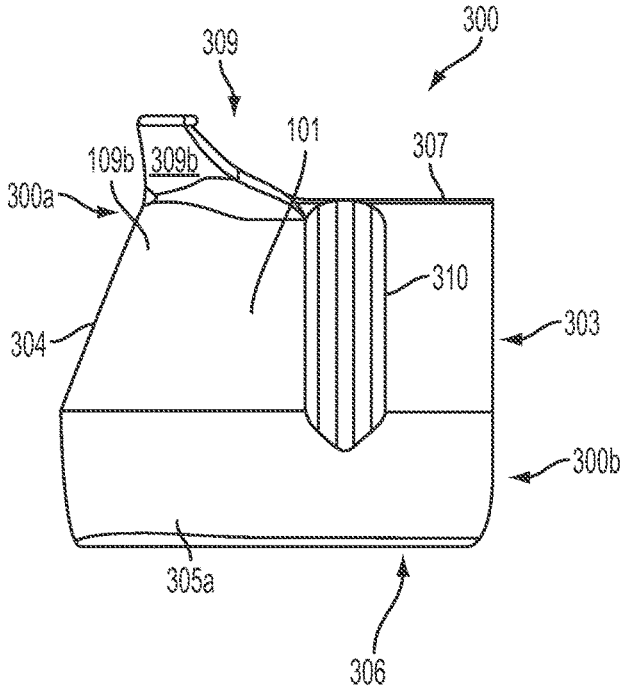
Figure 3C:
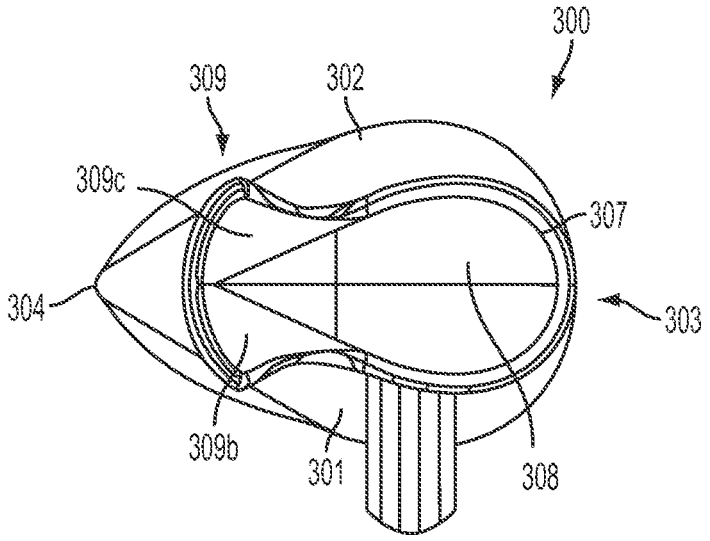
Figure 3D:
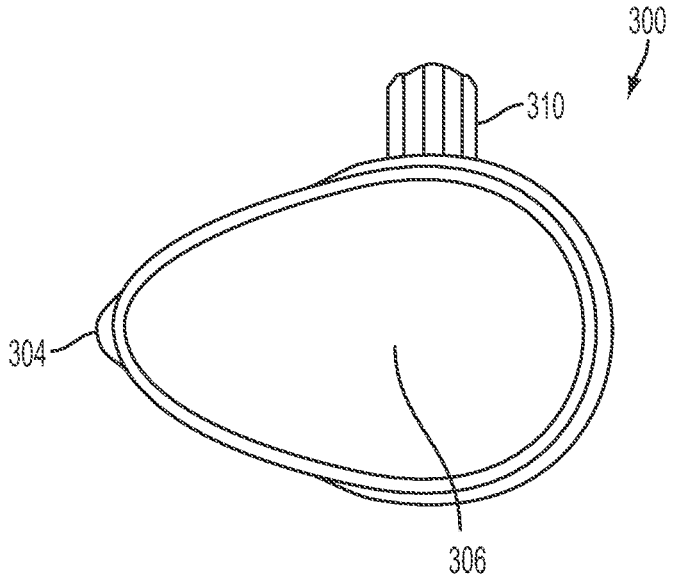
Figure 3E:
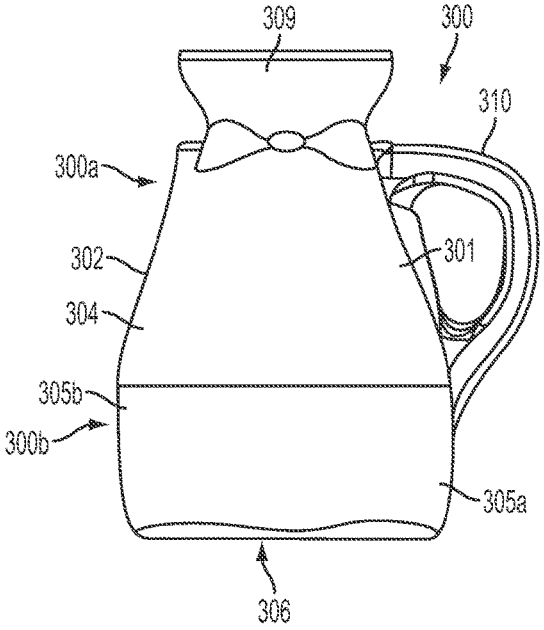
Figure 3F:
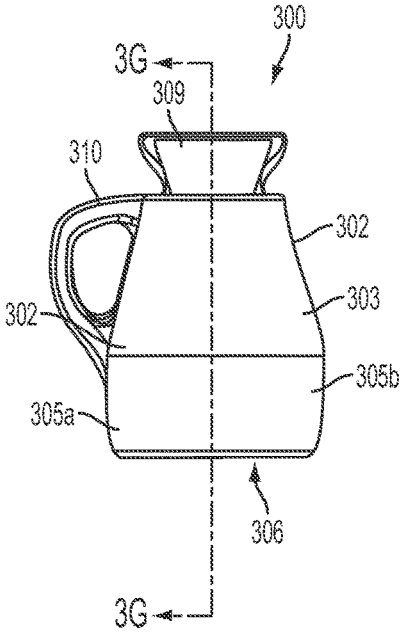
Figure 3G:
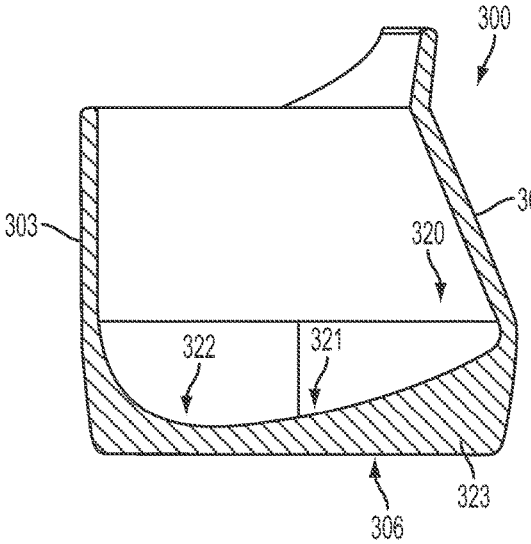
Figure 3H:
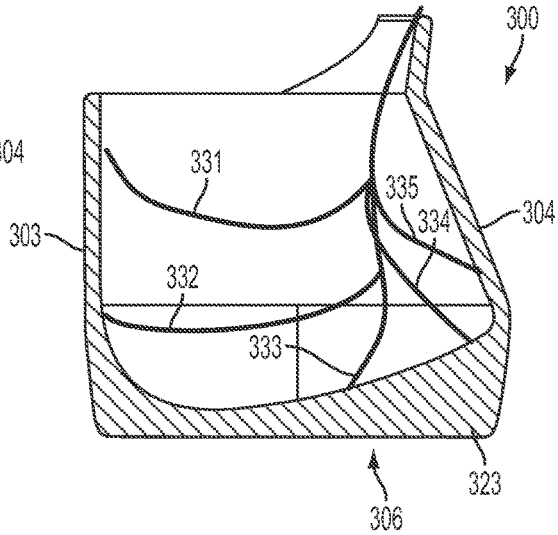
Figure 3I:
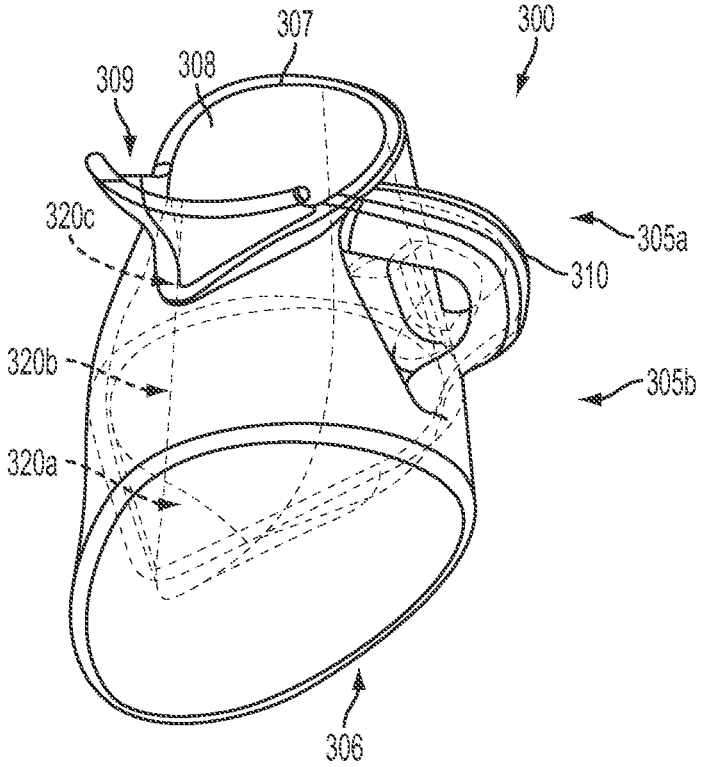

FIGS. 3A-3I show perspective views of an example capillary beverage cup 300. FIG. 3A shows a view of capillary beverage cup 300 from angled perspective. Capillary beverage cup 300 retains many of the features of capillary beverage cup 100. The primary differences between the designs will be discussed in detail. FIG. 3B depicts capillary beverage cup 300 as viewed in profile from the right side. FIG. 3C depicts capillary beverage cup 300 as viewed from the top-down. FIG. 3D depicts capillary beverage cup 300 as viewed from the bottom-up. FIG. 3E depicts capillary beverage cup 300 as viewed from the front. FIG. 3F depicts capillary beverage cup 300 as viewed from the rear. FIG. 3G shows a cross-section of capillary beverage cup 300 taken along axis A-A, as shown in FIG. 3F. FIG. 3H shows a cross-section of capillary beverage cup 300 taken along axis A-A, and further showing the interior corner of the cup drawing liquid to the cusp lip at various liquid fill levels. FIG. 3I shows a view of capillary beverage cup 300 from angled perspective allowing for the visibility of some interior features.

Similarly to capillary beverage cup 100, capillary beverage cup 300 comprises an upper right face 301 and an upper left face 302. Upper right face 301 and upper left face 302 intersect at both the front and rear of the cup. At the rear of the cup, the upper left and right faces form upper rear face 303. Upper right face 301 and upper left face 302 intersect at the front of the cup at tapered front face 304. An upper portion 300*a* of capillary beverage cup 300 is formed by faces 301, 302, 303, and an upper portion of tapered front face 304. As viewed from the front (FIG. 1E) or rear (FIG. 1F), upper portion 300*a* tapers from the widest section of the cup towards rim 307, which defines the boundaries of open top 308. A lower portion 300*b* of capillary beverage cup 300 is formed by right bottom face 305*a*, left bottom face 305*b*, and base 306. Upper portion 300*a* includes lip interface 309. Lip interface 309 comprises cusp 309*a*, right lip interface 309*b*, and left lip interface 309*c*. Capillary beverage cup 300 also includes handle 310, protruding outwards from right face 301. A continuous interior corner 320 provides capillary forces on liquid stored internal to cup 300, driving liquid to lip interface 309 where it may be retrieved by a user.

Upper right face 301, upper left face 302, rear face 303, and tapered front face 304 form a tear drop profile at the intersection of right bottom face 305*a* and left bottom face 305*b*, as shown in FIG. 3C. Similarly to upper portion 100*a*, upper portion 300*a* maintains the tear drop profile while tapering towards rim 307, although the area of the cross-sections decrease approaching rim 307. In this example, upper right face 301 and upper left face 302 comprise a sigmoidal profile when viewed from the front (FIG. 3E) or rear (FIG. 3F) that has a lower degree of inflection (more linear) than that for capillary beverage cup 100.

Right bottom face 305*a* and left bottom face 305*b* form an egg-shaped profile at the intersection of base 306. The egg-shaped profile is maintained from the base to the intersection with upper portion 300*a*. However, the area of the base is smaller than the area at the intersection of upper portion 300*a* and lower portion 300*b*. As shown in FIGS. 3E and 3F, right bottom face 305*a* and left bottom face 305*b* taper as they approach base 306, demonstrating a concave-up curved profile when viewed from the front or rear. Right bottom face 305*a* and left bottom face 305*b* may form a continuous face around lower portion 300*b*. Base 306 has a flat profile. Similarly to base 106, base 306 may be configured to attach cup 300 to a surface, and in some examples, may comprise a fill port for delivering liquid to the interior of cup 300.

Handle 310 is shown attached to upper right face 301 and right bottom face 305*a*, but may be attached to any part the exterior of upper portion 300*a* and/or lower portion 300*b*, provided it does not interfere with the internal geometry or the lip interface of the cup. For example, a handle may be placed on the left side of the cup for left handed drinkers, or on the rear face of the cup for universal use. Handle 310 protrudes away from cup 101, attaching below lip 307 and at the interface of the upper and lower portions of the cup. Handle 310 includes an opening which may allow a user to insert a finger (See FIG. 5D, for example). In other configurations, a handle may accommodate two or more fingers, either through a single, larger opening, or through multiple adjacent openings. The underside of handle 310 is concave, allowing for a second finger to ergonomically provide support to the handle, and thus enhance the stability of the cup in a users' hand.

As shown in FIGS. 3B and 3D, capillary beverage cup 300 has a height of 3.15 inches, a length of 3.19 inches, and a width of 2.2 inches. With these dimensions, the cup is designed for a microgravity environment ($g \sim 10^{-6} g_o$, $g_o = 9.81\ m/s^2$). However, as long as the interior corner has a continuously tapering profile and the ratio between the low-curvature region and tapered region is maintained, the size of the cup may be increased over the indicated dimensions, provided $\rho g R_2 R_1/\sigma < 1$, where $\rho$ is the density difference across the free surface, g is the characteristic acceleration field strength in the direction of the cup height, $R_1$ is the characteristic dimension of the cup cross-section, $R_2$ is the characteristic dimension of the cup height, and a is the liquid surface tension. (Note that for a generally spherical liquid volume $R_1 \sim R_2$). The length and width shown in FIGS. 3B and 3D represent the length and width at the longest and widest dimensions of the cup, not including handle 310. The length and width thus correlate with the dimensions of the cross-section at the interface between upper portion 300*a* and lower portion 300*b*. The dimensions of both base 306 and open top 308 are thus smaller than the indicated dimensions.

In this example, the combined height of upper portion 300*a* and lower portion 300*b* (from base 306 to rim 307) is 2.56 inches, and lip interface 309 extends 0.59 inches above rim 307. Lip interface 309*a* includes cusp 309*a* that is continuous with interior corner 320. In this example, lip interface 309 comprises right lip interface 309*b* and left lip interface 309*c*, which form an ergonomic interface for a user's lips. Right lip interface 109*b* and left lip interface 109*c* each have a rounded, concave shape, allowing for placement of a user's upper lip above cusp 309*a*. In this example, lip interface 309 is connected to upper portion 300*a* via interface support 309*d*, which may be used to reinforce lip interface 309.

Figure 4C:
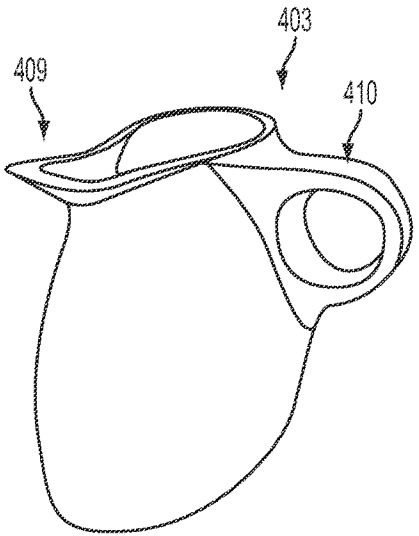
FIGS. 4B-4F show perspective views of an example capillary beverage cup.
Figure 4B:
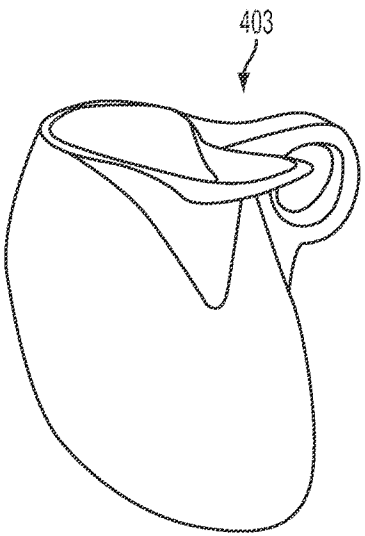
Figure 4A:
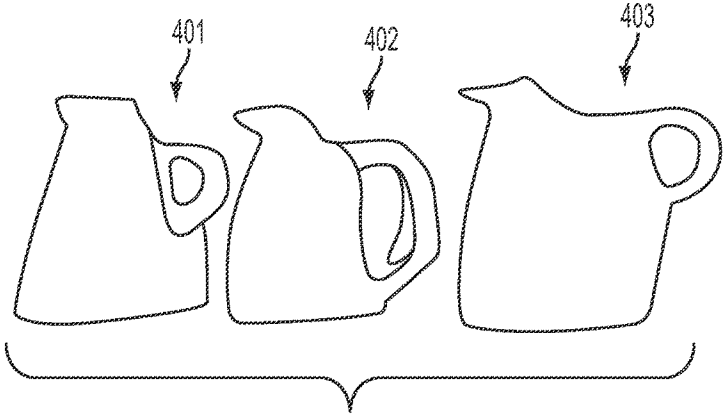
FIG. 4A shows profile views of example capillary beverage cups.

FIG. 3G shows a cutaway section of capillary beverage cup 300 along axis A-A, as shown in FIG. 3F. The cutaway section shows interior corner 320. Similarly to interior corner 120, interior corner 320 extends from the interior base mid-point 321 of lower portion 310*a*, and continuously tapers as the interior corner progresses towards lip interface 309 and cusp 309*a*. In this way, a continuous capillary gradient is provided to liquid stored within cup 300. As shown in FIG. 4A, the included angle between upper right face 301 and upper left face 302 becomes progressively smaller towards lip interface 309. Interior corner 320 may be divided in to tapering regions. For example, FIG. 4A shows large interior corner 320*a* in the lower region of upper portion 300*a*, primary interior corner 320*b* in the mid-region of upper portion 300*a*, and small interior corner 300*c* in the upper region of upper portion 300*a*. Large interior corner 320*a* has a larger included angle than that of primary interior corner 320*b*, which has a larger included angle than that of small interior corner 320*c*. It should be noted that interior corner 320 continuously tapers, and that the tapering regions may not be separated in any tangible form. Small interior corner 320*c* continues to taper and transition into cusp 309*a*, thereby ensuring a rivulet of liquid at lip interface 309.

FIG. 3G also shows rounded low curvature region 322 in the cross-section of capillary beverage cup 300. Similarly to capillary beverage cup 100, low curvature region 322 may be a generally spherical region, designed to improve the stability of liquid within cup 300. Low curvature region 322 may not include a corner region that transitions into interior corner 320. In this way, liquid contents of the low curvature region are acted on by minimal capillary forces compared to the interior corner. This allows the interior corner capillary action gradient to draw liquid from the low-curvature region to the interior corner as liquid is imbibed, thus ensuring complete drainage of the contents of the cup.

As capillary cup 300 comprises a flat base 306, low-curvature region may be defined by base fill region 323. In this example, the outer profile of cup 300 does not precisely extend the interior profile of the cup. Rather, the base allows for a more traditional looking cup, while enabling the interior geometry that allows for beverage imbibing in low-gravity environments. The base fill region extending from interior base mid-point 321 may define the wide-angle portion of interior corner 321, transitioning into the large interior corner defined by upper right face 301, upper left face 302, and tapered front face 304. FIG. 3H shows a sketched series of free surface profiles 331-335 for different fill levels of cup 300, where liquid profile 331 indicates a greater fill level than liquid profile 332, etc. Regardless of liquid fill level, interior corner 320 drives liquid towards lip interface 309 as liquid is removed from cup 300, allowing continuous access to liquid at lip interface 309, and thus providing means for the cup to be drained completely. As liquid is imbibed from the cup, and the fill level decreases, the bulk fluid profile changes, and a greater percentage of the fluid is retained by interior corner 320. For example, free surface profile 331 shows a mostly full cup 300, where the bulk of the fluid is contained within low-curvature region 322. For free surface profile 332, the liquid level within low-curvature region is decreased from free surface profile 331, but the interior corner profile is similar. As liquid fill level continues to decrease, the remaining liquid migrates from low-curvature region 322 to interior corner 320, until all of the liquid is within the interior corner, for example, as shown by free surface profile 335.

Figure 4E:
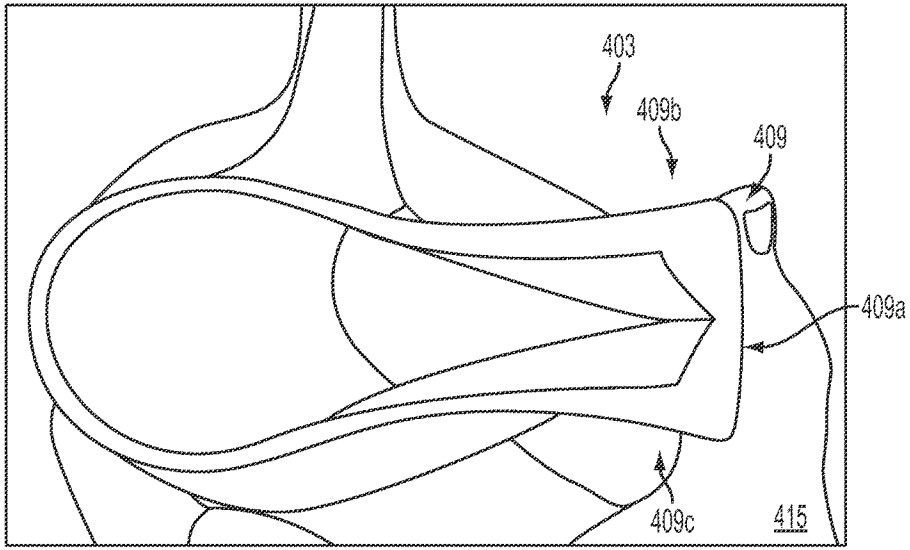
Figure 4D:
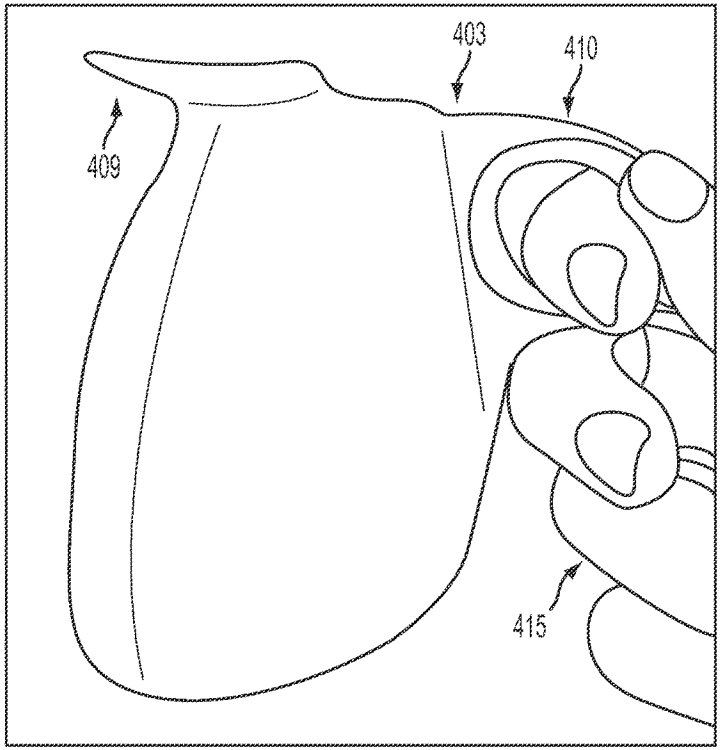
Figure 4F:
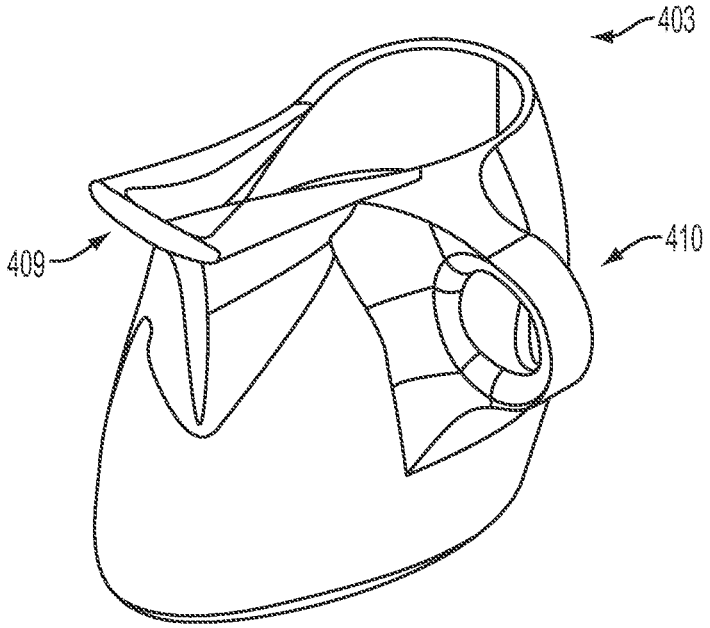
Figure 5A:
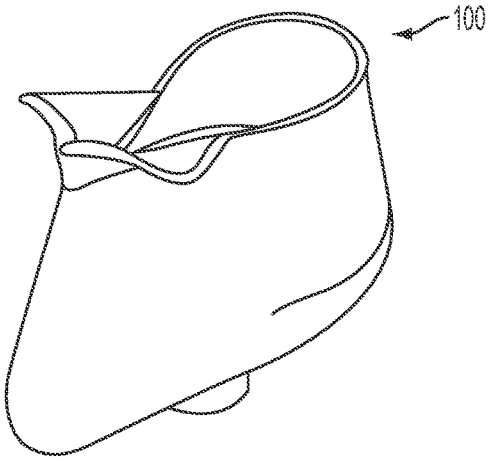
FIGS. 5A-5D show additional perspective views of the example capillary beverage cup depicted in FIGS. 1A-1G. Note: Figures are drawn approximately to scale, but other dimensions may be used.
Figure 5B:
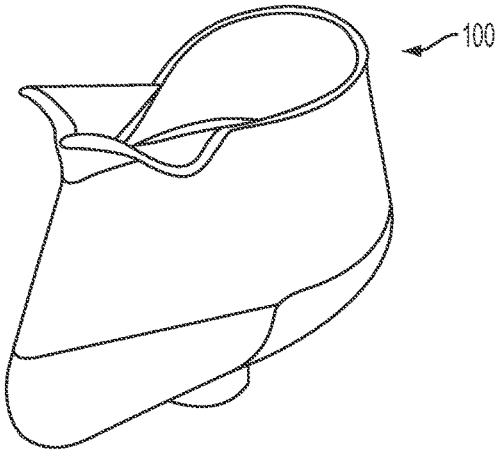
Figure 5C:
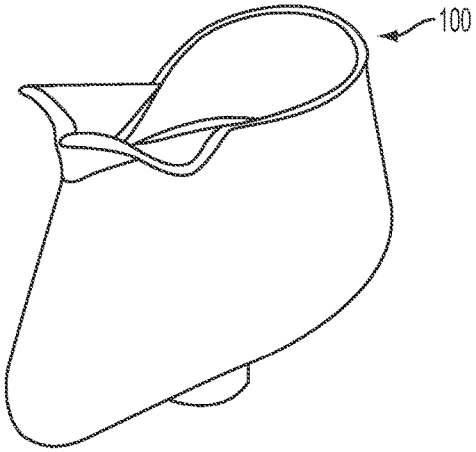
Figure 5D:
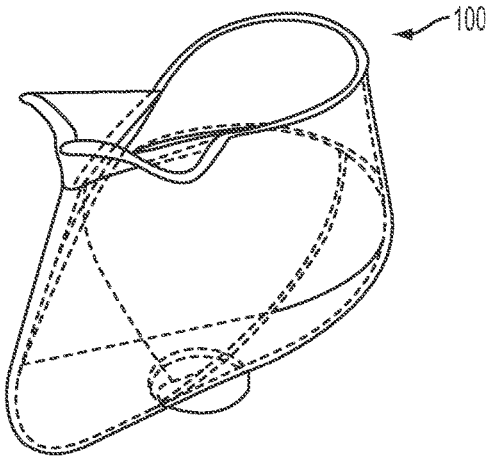

FIG. 4A shows profile views of example capillary beverage cups 401, 402, and 403 from a side perspective. In particular, variations in handle design and lip interface design can be seen. For example, capillary beverage cup 402 includes an extended handle that may accommodate two or more fingers between the handle and the body of the cup. FIGS. 4B-4F show additional perspective views of capillary beverage cup 403. FIG. 4B shows capillary beverage cup 403 viewed in perspective from the left side. FIG. 4C shows capillary beverage cup 403 viewed in perspective from the right side. FIG. 4D shows a user 415 holding capillary beverage cup 403 via handle 410. FIG. 4E shows capillary beverage cup 403 viewed from the top as held by user 415. FIG. 4F shows an illustration of capillary beverage cup 403.

Capillary beverage cup 403 is distinguishable from capillary beverage cup 300 primarily based on the design of handle 410 and lip interface 409. Handle 410 extends from the upper portion of capillary beverage cup 403, with the top surface of the handle situated close to the rim of the cup. Handle 410 has a round opening, allowing for the insertion of a finger, as shown in FIG. 4D. A second finger may be placed beneath the bottom surface of handle 410, allowing for additional stability.

Lip interface 409 includes a cusp 409*a*, clearly visible in FIG. 4E. Cusp 409*a* is continuous with an interior corner of cup 403, as described for capillary beverage cups 100 and 300. Lip interface 409 further includes right lip interface 409*b* and left lip interface 409*c*. Right lip interface 409*b* and left lip interface 409*c* are each slightly concave, but not to the extent shown for lip interfaces 109 and 309. However, this difference in design is purely ergonomic, as some users may prefer a flatter lip interface. The flatter lip interface design does not prevent a user from retrieving liquid from the cusp.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A capillary beverage cup, comprising:

a continuous interior corner extending from a lip interface into an inner cavity of the capillary beverage cup, the continuous interior corner comprising an acute included angle which tapers continuously as the interior corner approaches the lip interface, the lip interface extending above a rim of the capillary beverage cup, forming a cusp-shaped channel that is continuous with the interior corner, the lip interface comprising a right lip interface and a left lip interface wherein the right lip interface and left lip interface each have a rounded, concave shape;

an open top; and a lower portion comprising a rounded, low-curvature region, wherein a characteristic dimension of the open top is smaller than a characteristic dimension of a body radius of the capillary beverage cup, wherein the continuous interior corner does not extend into the rounded, low-curvature region, and wherein the lower portion further comprises:

a left front-bottom face;

a right front-bottom face;

a left rear-bottom face; and a right rear-bottom face, wherein the rounded, low-curvature region includes the left rear-bottom face and the right rear-bottom face, wherein the continuous interior corner extends into an interface between the left front-bottom face and right front-bottom face, and wherein the left rear-bottom face and the right rear-bottom face taper as they approach a base of the capillary beverage cup.

2. The capillary beverage cup of claim 1, where the continuous interior corner comprises:

an interior angle gradient configured to provide continuous capillary pressure on liquids with a contact angle less than 70°.

3. The capillary beverage cup of claim 2, wherein the continuous interior corner increasingly satisfies a critical geometric wetting condition as the continuous interior corner approaches the lip interface, and wherein the continuous interior corner seamlessly transitions into the cusp-shaped channel.

4. The capillary beverage cup of claim 1, wherein the cusp-shaped channel extends to an edge of the lip interface.

5. The capillary beverage cup of claim 1, wherein the right lip interface and left lip interface flank the cusp-shaped channel.

6. The capillary beverage cup of claim 5, wherein the right lip interface and left lip interface comprise a rounded, concave interface for a user's lips.

7. The capillary beverage cup of claim 1, further comprising:

an upper right face;

an upper left face; and wherein the upper right face and upper left face intersect at a tapered front face of the capillary beverage cup, forming an upper portion of the continuous interior corner.

8. The capillary beverage cup of claim 7, wherein the upper right face and upper left face intersect at a rear face of the capillary beverage cup forming a circular profile at a rear portion of the capillary beverage cup.

9. The capillary beverage cup of claim 1, wherein the inner cavity of the capillary beverage cup comprises a hydrophilic coating.

10. The capillary beverage cup of claim 1, wherein the inner cavity of the capillary beverage cup comprises a textured and/or hemi-porous surface.

11. The capillary beverage cup of claim 1, wherein the left rear-bottom face and the right rear-bottom face taper symmetrically as they approach the base, forming two sides of a semicubical parabola.

12. A capillary beverage cup, comprising:

a continuous interior corner extending from a lip interface into an inner cavity of the capillary beverage cup, the continuous interior corner comprising an acute included angle which tapers continuously as the interior corner approaches the lip interface, the lip interface extending above a rim of the capillary beverage cup, forming a cusp-shaped channel that is continuous with the interior corner, the lip interface comprising a right lip interface and a left lip interface wherein the right lip interface and left lip interface each have a rounded, concave shape;

an open top;

an upper right face; and an upper left face, wherein a characteristic dimension of the open top is smaller than a characteristic dimension of a body radius of the capillary beverage cup, wherein the upper right face and upper left face intersect at a tapered front face of the capillary beverage cup, forming an upper portion of the continuous interior corner, wherein the upper right face and upper left face intersect at a rear face of the capillary beverage cup forming a circular profile at a rear portion of the capillary beverage cup, wherein the upper right face and upper left face taper towards the open top of the capillary beverage cup forming a rim around the open top, and wherein the upper right face and upper left face demonstrate a sigmoidal profile when viewed from the front or rear, tapering towards the rim first as a concave-down curve, gradually transitioning to a concave-up curve.

13. A capillary beverage cup usable to provide a liquid for drinking in a low-gravity environment, the capillary beverage cup comprising:

an open top;

a lower portion comprising a rounded, low-curvature region;

an upper portion comprising a continuous interior corner extending into an inner cavity of the capillary beverage cup but not into the rounded, low-curvature region, the continuous interior corner comprising an acute included angle which expands as the continuous interior corner extends into the inner cavity, wherein the continuous interior corner is configured to apply a continuous capillary gradient on a liquid contained in the inner cavity; and a lip interface forming a cusp-shaped channel that is continuous with the continuous interior corner; the cusp-shaped channel shaped to supply a rivulet of liquid at the lip interface regardless of a quantity of liquid contained in the inner cavity, the lip interface extending above a rim of the capillary beverage cup, the lip interface comprising a right lip interface and a left lip interface wherein the right lip interface and left lip interface each have a rounded, concave shape.

14. The capillary beverage cup of claim 13, wherein a ratio of a height of the lower portion to a height of the upper portion is approximately 1:1.

15. A capillary beverage cup usable to provide a liquid for drinking, the capillary beverage cup comprising:

an open top;

a continuous interior corner extending from a lip interface into an inner cavity of the capillary beverage cup, the continuous interior corner comprising an acute included angle which tapers continuously as the interior corner approaches the lip interface at an angle gradient configured to provide continuous capillary pressure on liquids with a contact angle less than 70° and wherein the lip interface forms a cusp-shaped channel that is continuous with the continuous interior corner and extends to an edge of the lip interface, the lip interface extending above a rim of the capillary beverage cup, the lip interface comprising a right lip interface and a left lip interface wherein the right lip interface and left lip interface each have a rounded, concave shape;

an upper right face and an upper left face configured to intersect at a tapered front face of the capillary beverage cup, forming an upper portion of the continuous interior corner; and a lower portion, comprising:

a left front-bottom face;

a right front-bottom face;

a left rear-bottom face;

a right rear-bottom face; and wherein a rounded, low-curvature region includes the left rear-bottom face and the right rear-bottom face, and further wherein the continuous interior corner extends into an interface between the left front-bottom face and right front-bottom face but does not extend into the rounded, low-curvature region.

* * * * *